US011669029B2

(12) United States Patent
Sakaguchi et al.

(10) Patent No.: US 11,669,029 B2
(45) Date of Patent: Jun. 6, 2023

(54) IMAGE FORMING APPARATUS PERFORMING CURL SUPPRESSING PROCESS

(71) Applicant: BROTHER KOGYO KABUSHIKI KAISHA, Nagoya (JP)

(72) Inventors: Shintaro Sakaguchi, Nagoya (JP); Noriaki Kishimoto, Aichi (JP); Shuhei Fukue, Nagoya (JP); Shunsuke Ueki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/530,117

(22) Filed: Nov. 18, 2021

(65) Prior Publication Data

US 2022/0163909 A1 May 26, 2022

(30) Foreign Application Priority Data

Nov. 20, 2020 (JP) ..... JP2020-193059

(51) Int. Cl.

| | |
|---|---|
| ***G03G 15/20*** | (2006.01) |
| ***B41J 3/60*** | (2006.01) |
| ***B65H 5/06*** | (2006.01) |
| ***B41J 13/00*** | (2006.01) |

(52) U.S. Cl.

CPC ..... *G03G 15/2028* (2013.01); *B41J 3/60* (2013.01); *B41J 13/0009* (2013.01); *B65H 5/06* (2013.01); *G03G 15/2064* (2013.01); *B65H 2801/06* (2013.01)

(58) Field of Classification Search

USPC ..... 399/328

See application file for complete search history.

(56) References Cited

U.S. PATENT DOCUMENTS

2015/0117925 A1 4/2015 Fuse
2017/0343938 A1* 11/2017 Tadomi ..... G03G 15/6573

FOREIGN PATENT DOCUMENTS

| | | | |
|---|---|---|---|
| JP | 2004-361513 | A | 12/2004 |
| JP | 2006-201535 | A | 8/2006 |
| JP | 2015-82103 | A | 4/2015 |
| JP | 2017-116624 | A | 6/2017 |

* cited by examiner

*Primary Examiner* — Quana Grainger
(74) *Attorney, Agent, or Firm* — Merchant & Gould P.C.

(57) ABSTRACT

An image forming apparatus includes a sheet tray, a feed roller, a transfer roller, a fuser, a conveying unit, and a controller configured to execute a normal process. The controller executes a particular process, when performing the single sided printing. The particular process is a process in which the controller is configured to execute a non-actual-printing process on a first surface of a first sheet, and then configured to execute the non-actual-printing on a first surface of a second sheet before executing an actual-printing process on a second surface of the first sheet. The non-actual-printing process is a process of conveying the sheet to the fuser without transferring the developer image onto the first surface of the sheet. The actual-printing process is a process of transferring the developer image onto the second surface of the sheet.

18 Claims, 11 Drawing Sheets

FIG.7A

FIRST DOUBLE SIDED PRINTING MODE

| DOUBLE SIDED MODE | PAGE |
|---|---|
| DOUBLE SIDES A | 2 |
| | 1 |
| DOUBLE SIDES B | 2 |
| | 4 |
| | 1 |
| | 3 |
| DOUBLE SIDES C | 2 |
| | 4 |
| | 6 |
| | 1 |
| | 8 |
| | ⋮ |
| | EVEN |
| | ODD |
| | EVEN |
| | ⋮ |
| | ODD |

FIG.7B

SECOND DOUBLE SIDED PRINTING MODE

| DOUBLE SIDED MODE | PAGE |
|---|---|
| DOUBLE SIDES A | 2 |
| | 1 |
| DOUBLE SIDES B | 2 |
| | 4 |
| | 1 |
| | 3 |
| DOUBLE SIDES D | 2 |
| | 4 |
| | 1 |
| | 6 |
| | 3 |
| | 8 |
| | ⋮ |
| | EVEN |
| | ODD |
| | EVEN |
| | ⋮ |
| | ODD |

FIG.7C

FIRST CURL-SUPPRESSING MODE

| CURL-SUPPRESSING MODE | VIRTUAL PAGE | PROCESS |
|---|---|---|
| SINGLE SIDE A | 2 | NON-ACTUAL-PRINTING PROCESS |
| | 1 | ACTUAL-PRINTING PROCESS |
| SINGLE SIDE B | 2 | NON-ACTUAL-PRINTING PROCESS |
| | 4 | NON-ACTUAL-PRINTING PROCESS |
| | 1 | ACTUAL-PRINTING PROCESS |
| | 3 | ACTUAL-PRINTING PROCESS |
| SINGLE SIDE C | 2 | NON-ACTUAL-PRINTING PROCESS |
| | 4 | NON-ACTUAL-PRINTING PROCESS |
| | 6 | NON-ACTUAL-PRINTING PROCESS |
| | 1 | ACTUAL-PRINTING PROCESS |
| | 8 | NON-ACTUAL-PRINTING PROCESS |
| | ⋮ | ⋮ |
| | EVEN | NON-ACTUAL-PRINTING PROCESS |
| | ODD | ACTUAL-PRINTING PROCESS |
| | EVEN | NON-ACTUAL-PRINTING PROCESS |
| | ⋮ | ⋮ |
| | ODD | ACTUAL-PRINTING PROCESS |

FIG.7D

SECOND CURL-SUPPRESSING MODE

| CURL-SUPPRESSING MODE | VIRTUAL PAGE | PROCESS |
|---|---|---|
| SINGLE SIDE A | 2 | NON-ACTUAL-PRINTING PROCESS |
| | 1 | ACTUAL-PRINTING PROCESS |
| SINGLE SIDE B | 2 | NON-ACTUAL-PRINTING PROCESS |
| | 4 | NON-ACTUAL-PRINTING PROCESS |
| | 1 | ACTUAL-PRINTING PROCESS |
| | 3 | ACTUAL-PRINTING PROCESS |
| SINGLE SIDE D | 2 | NON-ACTUAL-PRINTING PROCESS |
| | 4 | NON-ACTUAL-PRINTING PROCESS |
| | 1 | ACTUAL-PRINTING PROCESS |
| | 6 | NON-ACTUAL-PRINTING PROCESS |
| | 3 | ACTUAL-PRINTING PROCESS |
| | 8 | NON-ACTUAL-PRINTING PROCESS |
| | ⋮ | ⋮ |
| | EVEN | NON-ACTUAL-PRINTING PROCESS |
| | ODD | ACTUAL-PRINTING PROCESS |
| | EVEN | NON-ACTUAL-PRINTING PROCESS |
| | ⋮ | ⋮ |
| | ODD | ACTUAL-PRINTING PROCESS |

IMAGE FORMING APPARATUS PERFORMING CURL SUPPRESSING PROCESS

CROSS REFERENCE TO RELATED APPLICATION

The present application claims priority from Japanese Patent Application No. 2020-193059, which was filed on Nov. 20, 2020, the disclosure of which is herein incorporated by reference in its entirety.

BACKGROUND

The following disclosure relates to an image forming apparatus comprising a fixing unit configured to fix a toner image onto a sheet.

There has been known a conventional image forming apparatus configured to execute humidity control operation in which heating and pressing are performed on a sheet in a fixing unit without transferring toner onto a first surface of the sheet supplied by a supplier when the humidity is equal to or greater than a predetermined value, and then execute a printing process in which toner is transferred onto a second surface of the sheet and the toner is fixed. Due to this technique, curl of the sheet is suppressed. In this technique, in a case where a plurality of sheets are printed, the humidity control operation and the printing process for the first sheet are executed, and then the humidity control operation and the printing process for the second sheet are executed.

SUMMARY

However, in the conventional technique, in the case where the plurality of sheets are printed, since a set of the humidity control operation and the printing process is executed for each of the plurality of sheets, there is a problem in which the speed of printing is reduced.

An aspect of the disclosure relates to an image forming apparatus capable of suppressing the curl of the sheet without reducing the speed of printing.

In one aspect of the disclosure, an image forming apparatus includes a sheet tray accommodating a sheet, a feed roller configured to feed the sheet from the sheet tray, a transfer roller configured to transfer a developer image onto the sheet fed by the feed roller, a fuser configured to fix the developer image on the sheet by heating and pressing, a conveying unit configured to convey the sheet which has passed the fuser in a state in which the sheet is turned upside down, the conveying unit being configured to re-convey the sheet to the transfer roller, and a controller configured to execute a normal process, when performing a single sided printing, the normal process being a process in which the controller is configured to form an image on a first surface of a first sheet without turning the first sheet upside down, and then configured to form an image on a first surface of a second sheet, which is supplied next to the first sheet from the sheet tray, without turning the second sheet upside down. The controller is configured to execute a particular process, when performing the single sided printing, the particular process being a process in which the controller is configured execute a non-actual-printing process on the first surface of the first sheet, and then configured to execute the non-actual-printing on the first surface of the second sheet before executing an actual-printing process on a second surface, which is opposite to the first surface, of the first sheet, the non-actual-printing process being a process of conveying the sheet to the fuser without transferring the developer image onto the first surface of the sheet in the transfer roller, the actual-printing process being a process of transferring the developer image onto the second surface of the sheet and fixing the developer image on the second surface by the fuser, the actual-printing process being executed after the controller re-conveys the sheet that has been processed by the non-actual-printing process to the transfer roller by the conveying unit.

In another aspect of the disclosure, an image forming apparatus includes a transfer roller configured to transfer a developer image on a sheet, a fuser configured to fix the developer image on the sheet by heating and pressing the sheet, a controller configured to execute an actual-printing process comprising transferring developer image on the sheet by the transfer roller and heating and pressing the sheet by the fuser, and a non-actual-printing process comprising heating and pressing the sheet by the fuser without transferring developer image on the sheet by the transfer roller. When performing a normal printing, the controller is configured to execute the actual-printing process for a first sheet, and then configured to execute the actual-printing process for a second sheet that is supplied next to the first sheet. When performing an anti-curl printing, the controller is configured to execute the non-actual-printing process for the first sheet, and then configured to execute the non-actual-printing process for the second sheet before executing the actual-printing process for the first sheet.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 7A is a table used in a first double sided printing mode;

FIG. 7B is a table used in a second double sided printing mode;

FIG. 7C is a table used in a first curl-suppressing mode;

FIG. 7D is a table used in a second curl-suppressing mode;

DETAILED DESCRIPTION OF THE EMBODIMENTS

Figure 1:
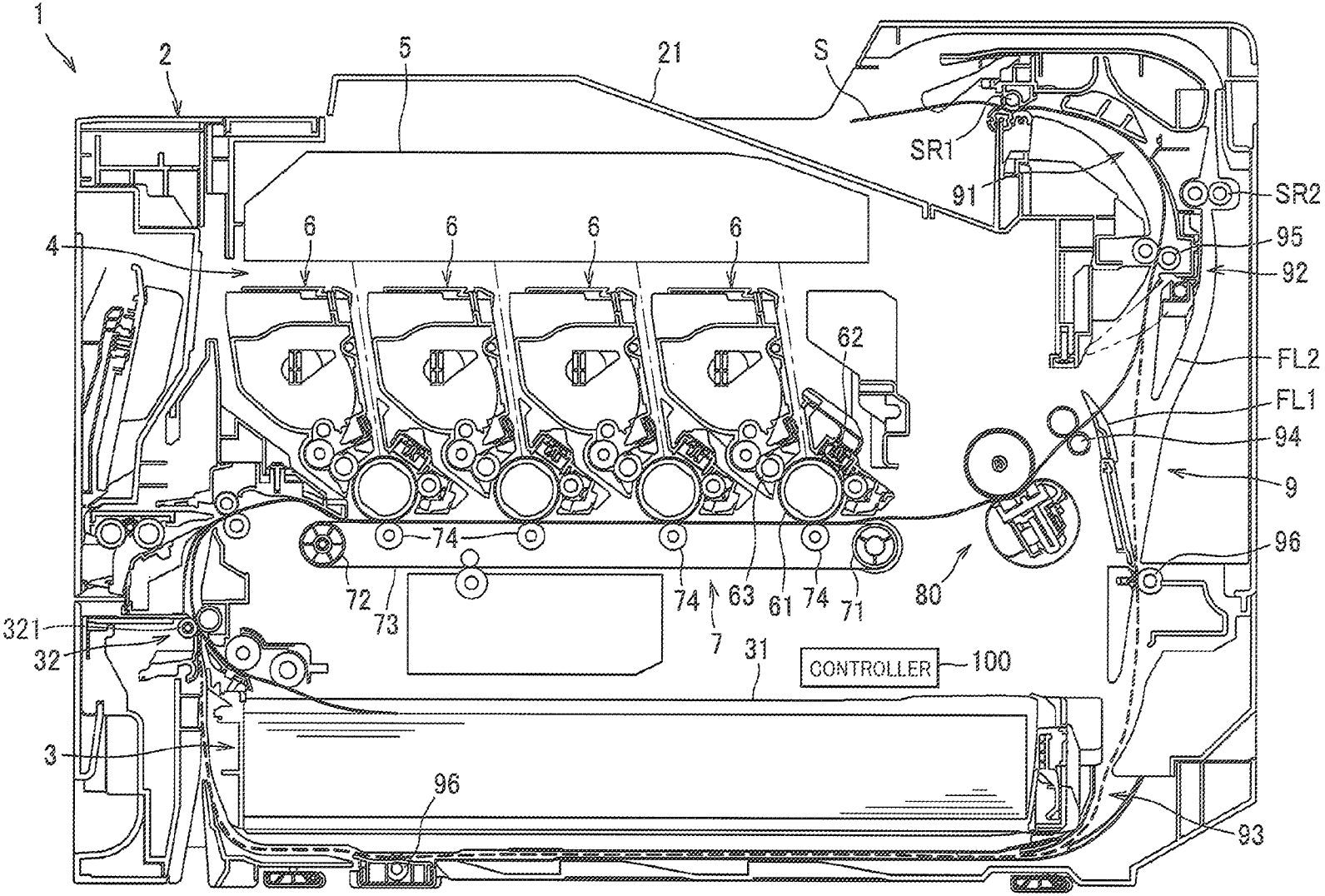
FIG. 1 is a cross-sectional view illustrating a color printer according to a first embodiment.

There will be described a first embodiment of this disclosure in detail by reference to the drawings. As illustrated in FIG. 1, a color printer 1 as an example of an image forming apparatus includes a body housing 2, a sheet supplier 3 disposed in the body housing 2, an image forming unit 4, a fixing unit 80, a conveying unit 9, and a controller 100.

A discharge tray 21 is disposed on an upper surface of the body housing 2.

The sheet supplier 3 is disposed at a lower portion in the body housing 2, and includes a sheet tray 31 and a supplier 32. The supply tray 31 accommodates the sheet S. The supplier 32 includes a feed roller 321 configured to supply a sheet from the sheet tray 31 to the image forming unit 4 by the feed roller 321.

The image forming unit 4 has a function of forming an image on the sheet S by transferring a developer image onto the sheet S, and includes an exposing device 5, four process cartridges 6, and a transfer unit 7.

The exposing device 5 is disposed at an upper portion in the body housing 2, and includes a light source and a polygon mirror each not illustrated, and so on. The exposing device 5 is configured to expose a surface of a photoconductor drum 61 by executing a high speed scanning on the surface of the photoconductor drum 61 by a light beam.

The process cartridges 6 includes the photoconductor drum 61, a charging unit 62, and a developing roller 63. In the four process cartridges 6, developer of each color of yellow, magenta, cyan, and black is stored, The transfer unit 7 has a function of transferring a developer image onto the sheet S supplied by the supplier 32. The transfer unit 7 includes a drive roller 71, a driven roller 72, a conveying belt 73, and four transfer rollers 74. The conveying belt 73 is an endless belt, and is wound around the drive roller 71 and the driven roller 72. Each of the transfer rollers 74 is disposed inside of the conveying belt 73 such that the conveying belt 73 is nipped between each of the transfer rollers 74 and a corresponding one of the photoconductor drums 61.

The charging unit 62 is configured to charge the surface of the photoconductor drum 61. And then, the exposing device 5 forms an electrostatic latent image on the surface of the photoconductor drum 61 by exposing the surface of the photoconductor drum 61.

The developing roller 63 is configured to supply developer to the electrostatic latent image formed on the surface of the photoconductor drum 61. As a result of this, a developer image is formed on the photoconductor drum 61. And then, when the sheet S is conveyed between the photoconductor drum 61 and the transfer roller 74 by the conveying belt 73, the developer image on the photoconductor drum 61 is transferred onto the sheet S.

The fixing unit 80 is a unit configured to fix the developer image to the sheet S by heating and pressing on the sheet S. The details of the fixing unit 80 will be described below.

The conveying unit 9 is configured such that the sheet S discharged from the fixing unit 80 is re-conveyed toward an outside of the body housing 2 or the image forming unit 4 in a state in which the sheet S is turned upside down. The conveying unit 9 includes a first conveyance path 91, a second conveyance path 92, a re-conveyance path 93, a first conveying roller 94, a second conveying roller 95, a first switchback roller SR1, a second switchback roller SR2, a plurality of re-conveying rollers 96, a pivotable first flapper FL1, and a pivotable second flapper FL2.

The first conveyance path 91 is a path guiding the sheet S discharged from the fixing unit 80 toward the discharge tray 21. The second conveyance path 92 is a path guiding the sheet S discharged from the fixing unit 80 toward the discharge tray 21 through a route different from the first conveyance path 91. The re-conveyance path 93 is a path guiding the sheet S which has been drawn into the body housing 2 by the first switchback roller SR1, which will be described below, and so on toward the supplier 32 located upstream of the image forming unit 4. The re-conveying rollers 96 are rollers disposed at the re-conveyance path 93 and configured to convey the sheet S in the re-conveyance path 93 toward the supplier 32.

The first conveying roller 94 is provided at the fixing unit 80. The first conveying roller 94 is configured to convey the sheet S on which the developer image has been heat-fixed toward the second flapper FL2.

The second conveying roller 95, the first switchback roller SR1, and the second switchback roller SR2 are rollers capable of rotating in both forward and reverse directions. The second conveying roller 95, the first switchback roller SR1, and the second switchback roller SR2 convey the sheet S toward the outside of the body housing 2, specifically, the discharge tray 21 at rotations in the forward direction, and draw the sheet S into the body housing 2 at rotations in the reverse direction.

The second conveying roller 95 and the first switchback roller SR1 are provided at the first conveyance path 91. The first switchback roller SR1 is disposed at a position closer to the discharge tray 21 than the second conveying roller 95. The second switchback roller SR2 is provided at the second conveyance path 92.

In the conveying unit 9, the sheet S can be conveyed from the fixing unit 80 toward the first conveyance path 91 or the second conveyance path 92 by switching positions of the first flapper FL1 and the second flapper FL2 properly, and can be conveyed from the first conveyance path 91 or the second conveyance path 92 toward the re-conveyance path 93.

Figure 2:
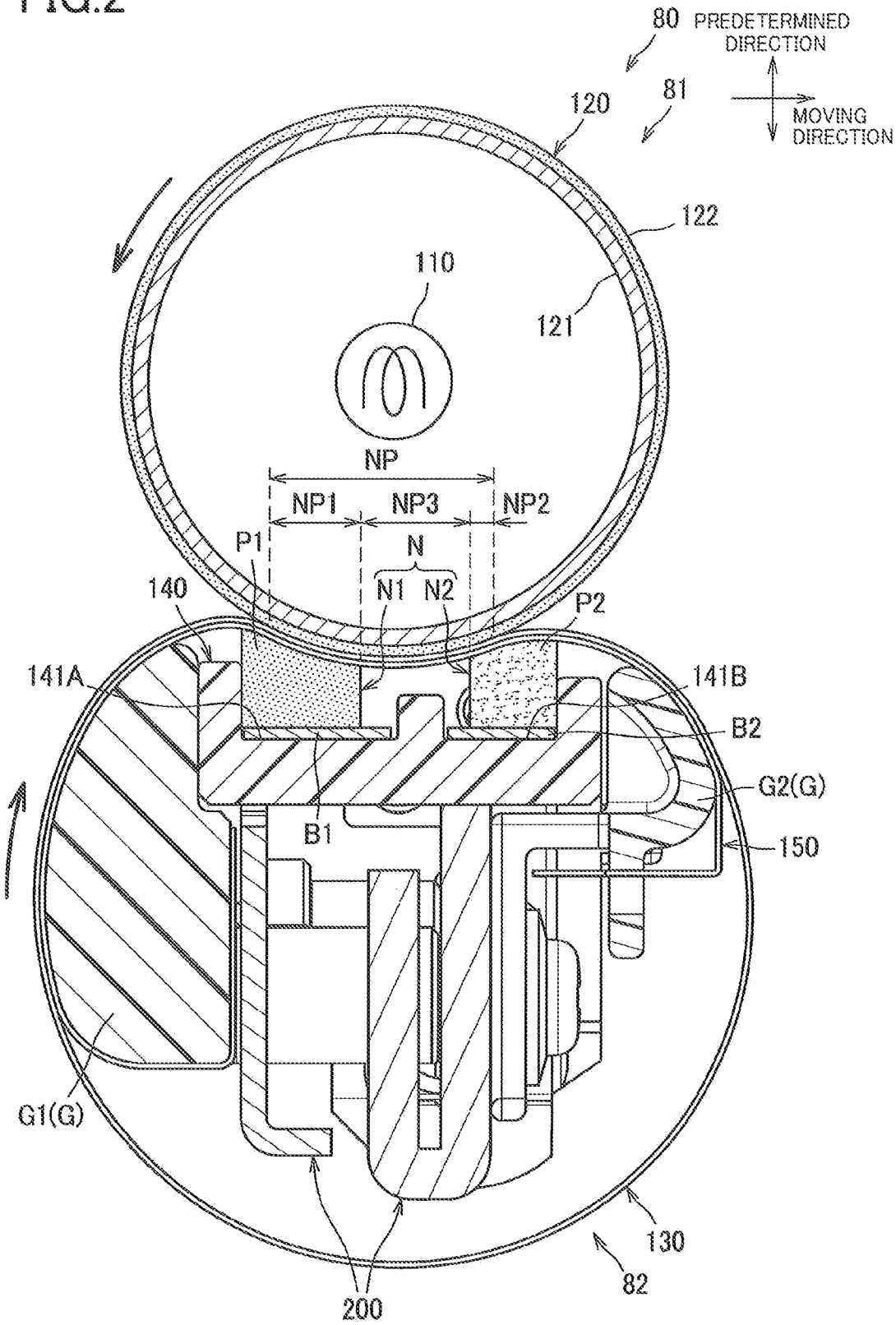
FIG. 2 is a cross-sectional view illustrating a fixing unit.

As illustrated in FIG. 2, the fixing unit 80 includes a first fixing member 81 and a second fixing member 82 as an example of a pressing unit. The first fixing member 81 includes a heater 110 and a roller 120 as an example of a heating unit.

The heater 110 is a halogen lamp, and configured to emit light and generate heat by energization to heat the roller 120 by radiant heat. The heater 110 is disposed so as to extend inside the roller 120 along a rotation axis of the roller 120. Here, a direction along the rotation axis of the roller 120 is an axial direction of the first fixing member 81, and the direction along the rotation axis of the roller 120 will be also refereed to merely as an "axial direction" in the following description.

The roller 120 is a tubular roller and heated by the heater 110. The roller 120 includes a tube blank 121 made of metal or the like, and an elastic layer 122 covering an outer circumferential surface of the tube blank 121. The elastic layer 122 is made of rubber such as silicone rubber.

Both end portions of the roller 120 in the axial direction are rotatably supported by a later-described frame FL, specifically, side frames 83 (see FIG. 3), and the end portions of the roller 120 are driven to rotate in a counterclockwise direction of FIG. 2 when the drive force is inputted from the motor M.

The second fixing member 82 is linearly movable in a predetermined direction that is a direction coming close to/going away from the first fixing member 81. The predetermined direction is orthogonal to the axial direction. The second fixing member 82 is urged toward the first fixing member 81 by a later-described nip-pressure changing mechanism 300 (see FIG. 3).

The second fixing member 82 includes an endless belt 130, a nip forming member N, a holder 140, a stay 200, a belt guide G, and a sliding sheet 150.

The belt 130 is configured such that the sheet S is nipped between the roller 120 and the belt 130 when the developer image is fixed to the sheet. The belt 130 is a long tubular member, having flexibility. The belt 130 has a base material made of such as metal or resin and a mold release layer covering an outer circumferential surface of the base material, though not illustrated. The belt 130 is driven to be rotated in a clockwise direction of FIG. 2 by friction with the roller 120 or the sheet P when the rotor 120 rotates. Lubricant such as grease is applied to an inner circumferential surface of the belt 130. The nip forming member N, the holder 140, the stay 200, the belt guide G, and the sliding sheet 150 are disposed inside the belt 130.

The nip forming member N forms the nip portion NP when the belt 130 is nipped between the nip forming member N and the roller 120. The nip forming member N includes a first nip forming member N1 and a second nip forming member N2.

The first nip forming member N1 includes a first pad P1 and a first fixing plate B1.

The first pad P1 is a rectangular parallelepiped member. The first pad P1 is made of rubber such as silicone rubber. The first pad P1 forms an upstream nip portion NP1 when the belt 130 is nipped between the first pad P1 and the roller 120.

In the following description, a moving direction of the belt 130 in the upstream nip portion NP1 and the later-described nip portion NP is referred to merely as a "moving direction". The moving direction is along an outer circumferential surface of the roller 120 in the embodiment. This direction is along a direction almost orthogonal to the predetermined direction and the axial direction; therefore, the moving direction is illustrated as the direction orthogonal to the predetermined direction and the axial direction. The moving direction is the same direction as the conveying direction of the sheet S in the nip portion NP. It is noted that an upstream side and a downstream side in the moving direction are also referred to merely as "upstream, downstream" in the following description.

The first pad P1 is fixed to a surface of the first fixing plate B1 on the roller 120 side. The first pad P1 slightly protrudes to the upstream side in the moving direction from an upstream end of the first fixing plate B1. Accordingly, the first pad P1 contacts the holder 140 on the upstream side.

The first fixing plate B1 is made of a member, for example, metal, harder than the first pad P1.

The second nip forming member N2 is disposed with a space on the downstream side of the first nip forming member N1 in the moving direction. That is, the second nip forming member N2 is spaced apart from the first nip forming member N1 in the conveying direction of the sheet S. The second nip forming member N2 has a second pad P2 and a second fixing plate B2.

The second pad P2 is a rectangular parallelepiped member. The second pad P2 is made of rubber such as silicone rubber. The second pad P2 forms a downstream nip portion NP2 when the belt 130 is nipped between the second pad P2 and the roller 120. The second pad P2 is spaced apart from the first pad P1 in the moving direction.

Accordingly, there exists an intermediate nip portion NP3, positioned between the upstream nip portion NP1 and the downstream nip portion NP2, on which pressure from the second fixing member 82 does not directly act. In the intermediate nip portion NP3, while the belt 130 is in contact with the roller 120, the belt 130 is not nipped between any of the first pad P1 and the second pad P2, and the roller 120; therefore, pressure is hardly applied. Accordingly, the sheet S passes the intermediate nip portion NP3 almost without being pressurized while being heated by the roller 120. In the embodiment, an area from an upstream end of the upstream nip portion NP1 to a downstream end of the downstream nip portion NP2, namely, the whole area where the outer circumferential surface of the belt 130 contacts the roller 120 is referred to as the nip portion NP. That is, in the embodiment, the nip portion NP includes the portion where a pressing force from the first pad P1 and the second pad P2 is not applied.

Figure 6A:
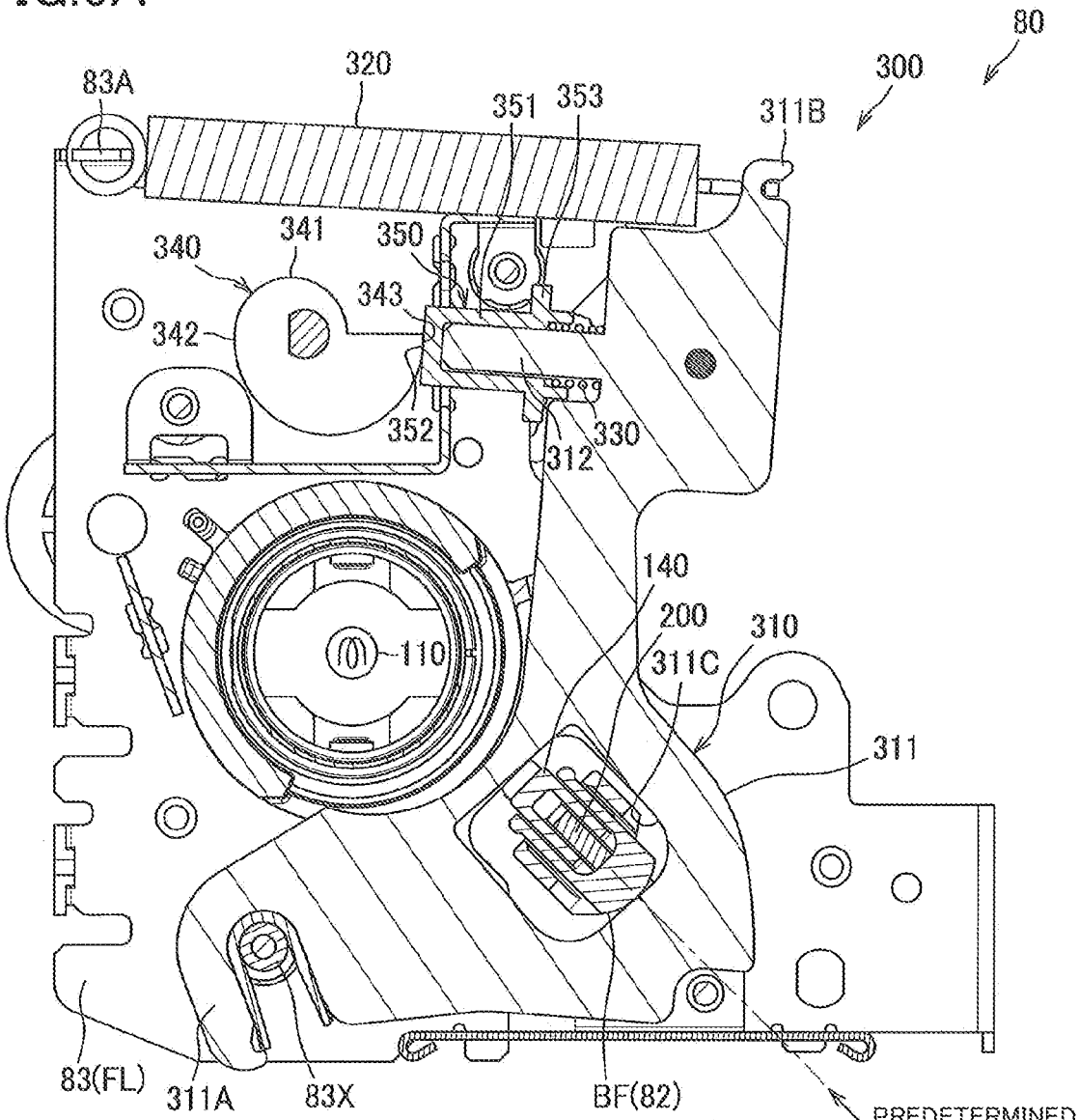
FIG. 6A is a cross-sectional view illustrating the changing mechanism when the nip state is in a low nip state.
Figure 6B:
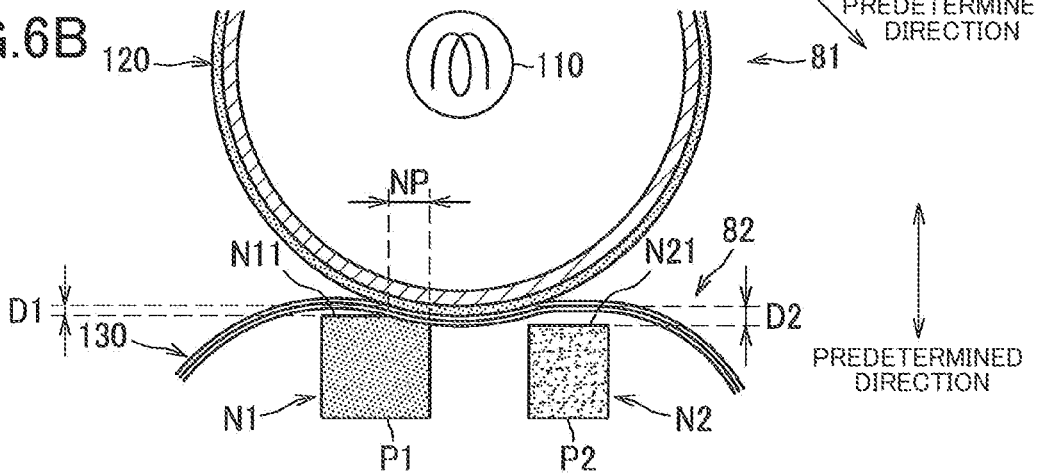
FIG. 6B is a cross-sectional view illustrating a configuration around the nip portion when the nip state is in the low nip state.

The second pad P2 is fixed to a surface of the second fixing plate B2 on the roller 120 side. The first pad P2 slightly protrudes to the downstream side from a downstream end of the second fixing plate B2 in the moving direction. Accordingly, the second pad P2 contacts the holder 140 on the downstream side. As illustrated in FIG. 6B, a dimension of the second pad P2 is smaller than a dimension of the first pad P1 in the predetermined direction.

The second fixing plate B2 is made of a member, for example, metal, harder than the second pad P2. A dimension of the second fixing plate B2 is the same as that of the first fixing plate B1 in the predetermined direction.

It is noted that the hardness of the first pad P1 is higher than the hardness of the elastic layer 122 of the roller 120. The hardness of the second pad P2 is higher than the hardness of the first pad P1. That is, the first pad P1 is softer than the second pad P2.

Here, the hardness means the durometer hardness specified by ISO7619-1. The durometer hardness is a value obtained from a pushing depth of a predetermined push needle at the time of pushing the push needle into a test piece under predetermined conditions. For example, in a case where a durometer hardness of the elastic layer 122 is 5, a durometer hardness of the first pad P1 is preferably 6 to 10, and a durometer hardness of the second pad P2 is preferably 70 to 90.

The hardness of the silicone rubber can be adjusted by changing a ratio of additives (a silica-based filler or a carbon-based filler) which is added at the time of manufacture. Specifically, when the ratio of additives is increased, the hardness of rubber is increased. The hardness can be reduced by adding silicone-based oil. As manufacturing methods for rubber, liquid injection molding and extrusion molding can be adopted. Generally, the liquid injection molding is suitable for low-hardness rubber, and the extrusion molding is suitable for high-hardness rubber.

The holder 140 is a member holding the nip forming member N. That is, the first nip forming member N1 and the second nip forming member N2 are supported by a single holder 140. The holder 140 is supported by the stay 200.

The holder 140 includes a first support surface 141A supporting a surface of the first nip forming member N1 on the opposite side of the first fixing member 81, and a second support surface 141B supporting a surface of the second nip forming member N2 on the opposite side of the first fixing member 81. The first support surface 141A and the second support surface 141B are located at the same position in the predetermined direction. That is, the first support surface 141A and the second support surface 141B are aligned with each other in the moving direction.

Accordingly, the first nip forming member N1 protrudes to the first fixing member 81 side more than the second nip forming member N2 as illustrated in FIG. 6B. In other words, a first distal end surface N11 which is a surface of the first nip forming member N1 on the first fixing member 81 side is located closer to the first fixing member 81 than a second distal end surface N21 which is a surface of the second nip forming member N2 on the first fixing member 81 side. More specifically, the first distal end surface N11 is located closer to the first fixing member 81 than the second distal end surface N21 in a state in which the respective nip forming members N1, N2 are not pressed onto the first fixing member 81.

Here, FIG. 6B illustrates a state in which only a part of the first distal end surface N11 of the first nip forming member N1 is pressed onto the first fixing member 81, and the other part of the first distal end surface N11 and the second distal end surface N21 are not pressed onto the first fixing member 81. Therefore, each of positions of the other part of the first distal end surface N11 and the second distal end surface N21 is the same position as each of positions of the other part of the first distal end surface N11 and the second distal end surface N2 in the state in which each of the nip forming members N1, N2 is not pressed onto the first fixing member 81. That is, the other part of the first distal end surface N11 is located closer to the first fixing member 81 than the second distal end surface N21. In other words, a shortest distance D1 between a portion, of the first distal end surface N11, to which pressure is not applied and the outer circumferential surface of the first fixing member 81 in the predetermined direction is smaller than a shortest distance D2 between the second distal end surface N21 to which pressure is not applied and the outer circumferential surface of the first fixing member 81.

The stay 200 is a member positioned on the opposite side of the nip forming member N with respect to the holder 140 and supporting the holder 140. The stay 200 is made of metal or the like. A buffer member BF made of resin or the like (see FIG. 4A) is mounted to an end portion of the stay 200 in the axial direction. The buffer member BF is a member for suppressing the stay 200 made of metal from being rubbed against a later-described metal arm 310 (see FIG. 4A).

The belt guide G is a member guiding an inner circumferential surface 131 of the belt 130. The belt guide G is made of resin or the like having heat resistance. The belt guide G includes an upstream guide G1 and a downstream guide G2.

The sliding sheet 150 is a rectangular sheet for reducing frictional resistance between the respective pads P1, P2 and the belt 130. The sliding sheet 150 is nipped between the inner circumferential surface 131 of the belt 130 and the respective pads P1, P2 in the nip portion NP. The sliding sheet 150 is made of an elastically deformable material. Any type of material can be used for the sliding sheet 150, but a resin sheet containing polyimide is adopted in the embodiment.

Figure 3:
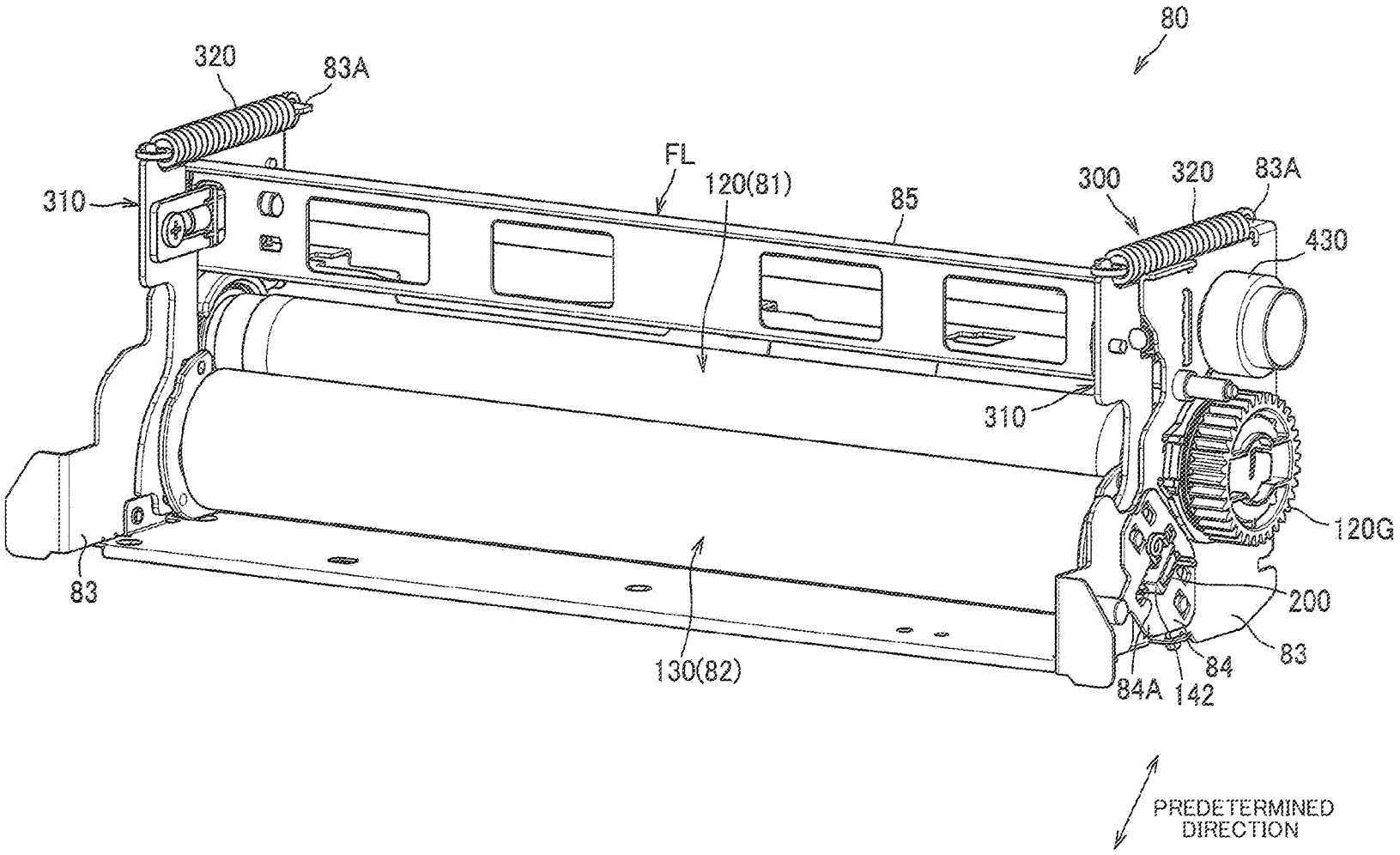
FIG. 3 is a perspective view illustrating a changing mechanism.

As illustrated in FIG. 3, the fixing unit 80 further includes the frame FL and the nip-pressure changing mechanism 300. The frame FL is a frame supporting the first fixing member 81 and the second fixing member 82, and the frame FL is made of metal or the like. The frame FL includes side frames 83 and brackets 84 disposed on both sides of the first fixing member 81 and the second fixing member 82 in the axial direction and a connection frame 85 connected to each of the side frames 83.

The side frames 83 are frames supporting the first fixing member 81 and the second fixing member 82. Each of the side frames 83 includes a spring engaging portion 83A engaging with one end portion of a later-described first spring 320.

The brackets 84 are members supporting the second fixing member 82 so as to be movable in the predetermined direction, and the brackets 84 are respectively fixed to the side frames 83. More specifically, the brackets 84 disposed on both sides in the axial direction have first long holes 84A supporting end portions 142 of the holder 140 in the axial direction so as to be movable in the predetermined direction. The first long holes 84A are long holes extending in the predetermined direction.

Here, the first long holes 84A correspond to grooves as guides. The end portions 142 of the holder 140 in the axial direction are respectively inserted into the first long holes 84A on both sides in the axial direction and the second fixing member 82 is supported so as to be movable in the predetermined direction. The grooves as guides may be bottomed grooves.

The nip-pressure changing mechanism 300 is a mechanism capable of changing the nip pressure of the nip portion NP. The nip-pressure changing mechanism 300 is driven by the controller 100, and is capable of switching a nip state of the first fixing member 81 and the second fixing member 82 to a strong nip state, a middle nip state in which a nip pressure is lower than that of the strong nip state, and a low nip state in which the nip pressure is lower than that of the middle nip state. Here, the belt 130 is nipped between at least one of the pads P1 and P2, and the first fixing member 81 in any state of the strong nip state, the middle nip state, and the low nip state.

Figure 4A:
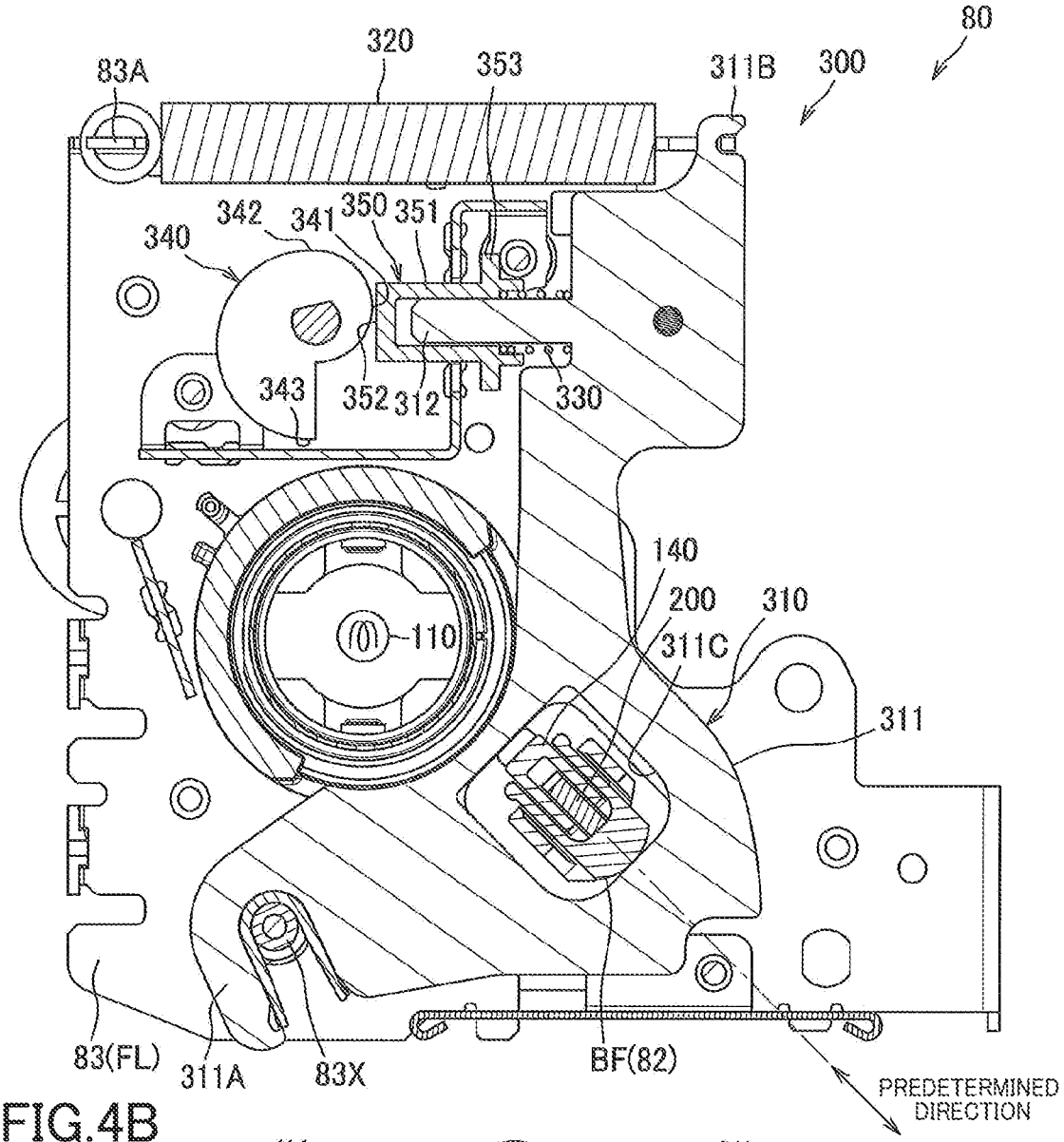
FIG. 4A is a cross-sectional view illustrating the changing mechanism when a nip state is in a strong nip state.

As illustrated in FIG. 4A, the nip-pressure changing mechanism 300 includes the arms 310, first springs 320, second springs 330, and cams 340. The arms 310, the first springs 320, the second springs 330 and the cams 340 are provided on one end side and the other end side of the frame FL in the axial direction, respectively.

Each of the arms 310 is a member for pressing the stay 200 toward the first fixing member 81 through the buffer member BF. Each of the arms 310 supports the second fixing member 82 and is supported by the side frame 83 so as to be pivotable.

Each of the arms 310 has an arm body 311 and a cam follower 350. The arm body 311 is a plate-like member with an L-shape made of metal or the like.

Each of the side frames 83 includes a boss 83X supporting the arm body 311 so as to be pivotable. The arm body 311 includes one end portion 311A supported by the boss 83X of the side frame 83 so as to be pivotable, the other end portion 311B to which the first spring 320 is coupled, and an engaging hole 311C supporting the second fixing member 82. The engaging hole 311C is disposed between the one end portion 311A and the other end portion 311B, and engaged with the buffer member BF.

The arm body 311 further includes a guide protrusion 312 extending toward the cam 340. The guide protrusion 312 supports the cam follower 350 so as to be pivotable.

The cam follower 350 can contact the cam 340. The cam follower 350 is made of resin or the like, and includes a tubular portion 351 fitted into the guide protrusion 312, a contact portion 352 provided at one end of the tubular portion 351, and a flange portion 353 provided at the other end of the tubular portion 351.

The tubular portion 351 is supported by the guide protrusion 312 so as to be movable in a direction in which the guide protrusion 312 extends. The contact portion 352 is a wall blocking an opening of the end portion of the tubular portion 351 on the cam 340 side, and the contact portion 352 is disposed between the cam 340 and a tip end of the guide protrusion 312. The flange portion 353 protrudes from the other end of the tubular portion 351 in a direction orthogonal to the moving direction of the cam follower 350.

Then, the second spring 330 is disposed between the tubular portion 351 and the arm body 311. Accordingly, the arm body 311 is urged by the first spring 320 and can be urged by the second spring 330.

The first spring 320 is a spring configured to apply a load to the nip portion NP by applying a first urging force to the second fixing member 82. Specifically, the first spring 320 applies the first urging force to the second fixing member 82 through the arm body 311. The first spring 320 is an extension coil spring made of metal or the like, an end of the first spring 320 is coupled to the spring engaging portion 83A of the side frame 83, and the other end pf the first spring 320 is coupled to the other end portion 311B of the arm body 311.

The second spring 330 is a spring capable of applying a second urging force to the second fixing member 82 in a direction opposite to the first urging force. Specifically, the second spring 330 can apply the second urging force to the second fixing member 82 through the arm body 311. The second spring 330 is a compression coil spring made of the metal or the like, and is disposed between the tubular portion 351 and the arm body 311 in a state in which the guide protrusion 312 is inserted into a space surrounded by the compression coil spring.

The cam 340 is a member configured to move the second fixing member 82 in the predetermined direction by pressing the arm 310 through the cam follower 350. The cam 340 has a function of changing an extension/contraction state of the second spring 330 to a first extension/contraction state in which the second urging force is not applied to the second fixing member 82, a second extension/contraction state in which the second urging force is applied to the second fixing member 82, and a third extension/contraction state in which the spring is more deformed than the second extension/contraction state. The cam 340 is controlled by the controller 100 so as to be pivotable to be positioned at a first cam position illustrated in FIG. 4A, a second cam position illustrated in FIG. 5A, and a third cam position illustrated in FIG. 6A.

The cam 340 is made of resin or the like, and includes a first portion 341, a second portion 342, and a third portion 343. The first portion 341, the second portion 342, and the third portion 343 are located on an outer circumferential surface of the cam 340.

The first portion 341 is a portion closest to the cam follower 350 when the cam 340 is located at the first cam position. As illustrated in FIG. 4A, the first portion 341 is spaced apart from the cam follower 350 when the cam 340 is located at the first cam position.

Figure 5A:
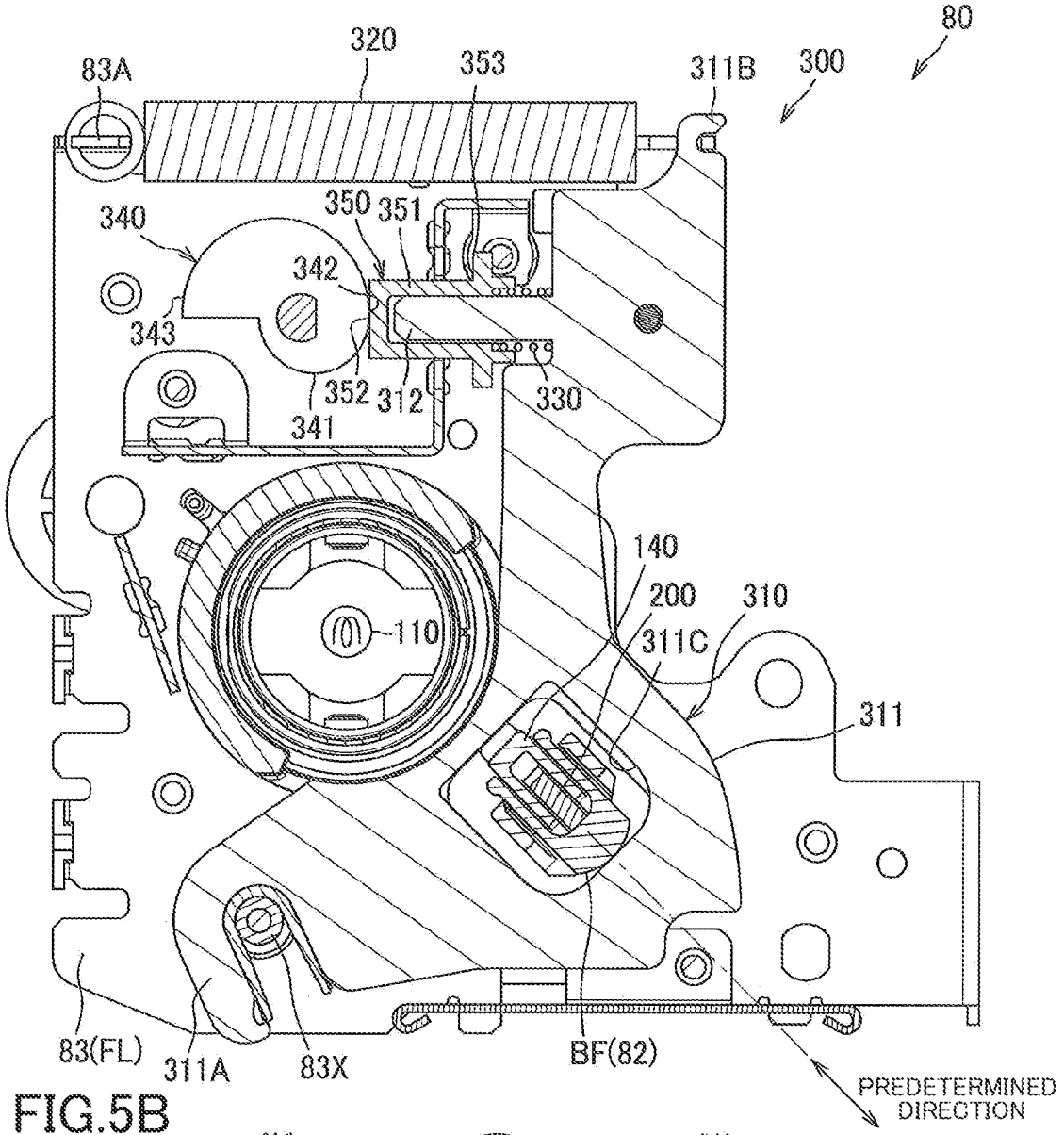
FIG. 5A is a cross-sectional view illustrating the changing mechanism when the nip state is in a middle nip state.

The second portion 342 is a portion which comes into contact with the cam follower 350 when the cam 340 is located at the second cam position. More specifically, the second portion 342 is a portion which comes into contact with the cam follower 350 when the cam 340 pivots approximately 90 degrees in the illustrated clockwise direction from the first cam position as illustrated in FIG. 5A. A distance from the second portion 342 to a pivot center of the cam 340 is greater than a distance from the first portion 341 to the pivot center of the cam 340.

The third portion 343 is a portion which comes into contact with the cam follower 350 when the cam 340 is located at the third cam position. More specifically, the third portion 343 is a portion in a state in which the cam 340 pivots approximately 270 degrees in the illustrated clockwise direction from the first cam position, in other words, a portion which comes into contact with the cam follower 350 when the cam 340 pivots approximately 180 degrees in the illustrated clockwise direction from the second com position as illustrated in FIG. 6A. A distance from the third portion 343 to the pivot center of the cam 340 is greater than the distance from the second portion 342 to the pivot center of the cam 340.

When the cam 340 is located at the first cam position, the cam 340 is spaced apart from the cam follower 350; therefore, the extension/contraction state of the second spring 330 is in the first extension/contraction state. When the cam 340 causes the extension/contraction state of the second spring 330 to be in the first extension/contraction state as described above, the arm body 311 is in a first posture illustrated in FIG. 4A.

Specifically, the cam 340 is spaced apart from the cam follower 350 when the cam 340 causes the extension/contraction state of the second spring 330 to be in the first extension/contraction state; therefore, the second urging force of the second spring 330 is not applied to the second fixing member 82 through the arm body 311, and only the first urging force of the first spring 320 is applied to the respective pads P1, P2 of the second fixing member 82 through the arm body 311. When the first urging force is applied to the second fixing member 82 by the first spring 320 and the second urging force is not applied to the second fixing member 82 by the second spring 330 as described above, the nip state is in the strong nip state, and the nip pressure is a strong nip pressure.

When the cam 340 pivots from the first cam position illustrated in FIG. 4A to the second cam position illustrated in FIG. 5A, the cam 340 comes into contact with the cam follower 350 and moves the cam follower 350 by a predetermined amount with respect to the arm body 311. Accordingly, the extension/contraction state of the second spring 330 is in the second extension/contraction state in which the spring is more deformed than the first extension/contraction state when the cam 340 is located at the second cam position.

The cam follower 350 is supported by the cam 340 when the cam 340 is located at the second cam position; therefore, the second urging force of the second spring 330 is applied to the second fixing member 82 in the direction opposite to the first urging force through the arm body 311. Accordingly, when the first urging force is applied to the second fixing member 82 by the first spring 320 and the second urging force is applied to the second fixing member 82 in the direction opposite to the first urging force by the second spring 330, the nip state is in the middle nip state, and the nip pressure is a middle nip pressure smaller than the strong nip pressure. Here, the strong nip pressure or the middle nip pressure corresponds to the first nip pressure.

When the cam 340 causes the extension/contraction state of the second spring 330 to be in the second extension/contraction state, the arm body 311 remains in the above-described first posture. Here, in the state in which the second pad P2 is pressed onto the roller 120, namely, in the state in which the load is applied to the second pad P2, the second pad P2 is hardly deformed regardless of magnitude of the load. Then, the second pad P2 is hardly deformed; therefore, the posture of the stay 200 supporting the second pad P2 and the posture of the arm 310 supporting the stay 200 are maintained almost in fixed postures regardless of magnitude of the load. Since the position of the first pad P1 is determined by the position of the second pad P2, the position of the first pad P1 is not changed in a state in which the second pad P2 is hardly deformed and the position of the second pad P2 is not changed. Therefore, an entire nip width (a length from an entrance of the upstream nip portion NP1 to an exit of the downstream nip portion NP2) is not changed and the posture of the arm 310 is maintained almost in the fixed posture in both cases of the strong nip state (the strong nip pressure) and the middle nip state (the middle nip pressure).

Figure 4B:
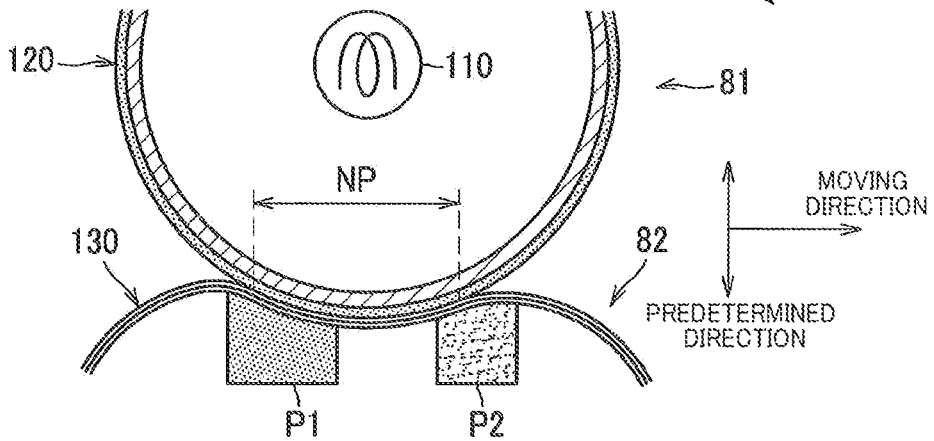
FIG. 4B is a cross-sectional view illustrating a configuration around a nip portion when the nip state is in the strong nip state.
Figure 5B:
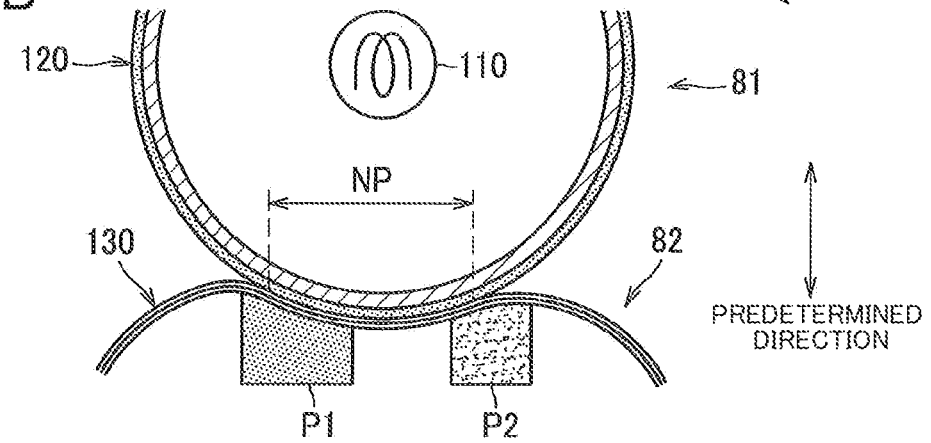
FIG. 5B is a cross-sectional view illustrating a configuration around the nip portion when the nip state is in the middle nip state.

Since the posture of the arm body 311 is in the first posture even when the extension/contraction state of the second spring 330 is any one of the first extension/contraction state and the second extension/contraction state as described above, the belt 130 is nipped between each of the first pad P1 and the second pad P2, and the roller 120 in both a state in which the nip pressure is the strong nip pressure and a state in which the middle nip pressure as illustrated in FIG. 4B and FIG. 5B.

When the cam 340 pivots from the second cam position illustrated in FIG. 5A to the third cam position illustrated in FIG. 6A, the cam 340 further moves the cam follower 350 with respect to the arm body 311, and then the cam 340 presses the arm body 311 through the cam follower 350. Accordingly, the extension/contraction state of the second spring 330 becomes in the third extraction/contraction state in which the spring is more deformed than the second extension/contraction state, and the arm body 311 pivots from the first posture to a second posture different from the first posture.

Specifically, in an early stage in a pivoting process in which the cam 340 pivots from the second cam position to the third cam position, the cam follower 350 moves with respect to the arm body 311 so that the contact portion 352 of the cam follower 350 comes close to the tip end of the guide protrusion 312. When the contact portion 352 comes into contact with the tip end of the guide protrusion 312, the extension/contraction state of the second spring 330 becomes in the third extraction/contraction state. In the case in which the cam 340 causes the extension/contraction state of the second spring 330 to be in the third extraction/contraction state, the contact portion 352 as a part of the cam follower 350 is nipped between the cam 340 and the guide protrusion 312. After that, when the cam 340 further pivots, the cam 340 presses the guide protrusion 312 through the contact portion 352; therefore, the arm body 311 pivots from the first posture to the second posture against the urging force of the first spring 320.

Accordingly, when the arm body 311 is in the second posture, the second fixing member 82 is disposed at a position more spaced apart from the roller 120 (the position of FIG. 6B) than a position of the second fixing member 82 in which the arm body 311 is in the first posture (the position of FIG. 5B). Since the position of the second fixing member 82 with respect to the roller 120 is changed as described above, the width of the nip portion NP becomes smaller when the arm body 311 is in the second posture than in the case in which the arm body 311 is in the first posture as illustrated in FIG. 6B, and the nip pressure becomes a low nip pressure smaller than the middle nip pressure. That is, since the posture of the arm 310 is changed by the cam 340, the nip pressure and the nip width are changed. Specifically, when the arm 310 is in the second posture, the nip state is in the low nip state in which the belt 130 is nipped only between the first pad P1 and the roller 120 and the belt 130 is not nipped between the second pad P2 and the roller 120. Accordingly, when the arm 310 is in the second posture, an upstream nip pressure and an upstream nip width become small and the downstream nip pressure becomes zero. Moreover, since the urging force of the first spring 320 can be received by the cam 340 through the arm body 311 and the contact portion 352 of the cam follower 350 in the low nip state, the urging force of the first spring 320 is not applied to the first pad P1. That is, the nip portion NP is formed only by deformation of the first pad P1 in the low nip state. It is noted that the low nip pressure corresponds to the second nip pressure smaller than the first nip pressure.

The controller 100 includes, for example, a CPU, a RAM, a ROM, and an input/output circuit. The controller 100 is executable of a curl-suppressing process to suppress curl of the sheet in a case where the controller 100 performs a single sided printing for the sheet S.

The curl-suppressing process includes a non-actual-printing process and an actual-printing process. The non-actual-printing process is a process of conveying the sheet S to the fixing unit 80 without transferring the developer image onto a first surface of the sheet S in the transfer unit 7. The actual-printing process is a process of transferring the developer image onto a second surface opposite to the first surface of the sheet S in the transfer unit 7 after the sheet S for which the non-actual-printing process has been executed is re-conveyed to the transfer unit 7 by the conveying unit 9, and then fixing the developer image to the second surface of the sheet S in the fixing unit 80. Here, the first surface is a surface of the sheet S that first comes into contact with the photoconductor drum 61 in a double sided printing, and the second surface is a surface of the sheet S which comes into contact with the photoconductor drum 61 after the sheet S is re-conveyed.

Specifically, the controller 100 executes the curl-suppressing process by steps similar to the double sided printing. In the following description, there will be described the curl-suppressing process after being described the double sided printing.

There are two modes, a first double sided printing mode in which the controller 100 controls the second flapper FL2 to perform the double sided printing by using the two conveyance paths 91, 92 and a second double sided printing mode in which the controller 100 performs the double sided printing by using only the first conveyance path 91 without controlling the second flapper FL2, as the double sided printing executable by the controller 100. Here, the two modes may be respectively, for example, set for models. For example, the first double sided printing mode may be set for the controller 100 of a first model, and the second double sided printing mode may be set for the controller 100 of a second model. Moreover, the two modes may be selectable, for example, by a user, and one of the first double sided printing mode and the second double sided printing mode may be selectively executable by the controller 100 of a predetermined model.

In a case where the controller 100 executes the first double sided printing mode, the controller 100 determines an order of pages to be printed based on a first table illustrated in FIG. 7A. In a case where the controller 100 executes the second double sided printing mode, the controller 100 determines an order of pages to be printed based on a second table illustrated in FIG. 7B. Moreover, when the controller 100 prints even-numbered pages in the double sided printing, the controller 100 is configured to supply the sheet S in the sheet tray 31 to the image forming unit 4.

"Double sides A" illustrated in a column of a double sided mode in each of the first table and the second table is a mode in which the controller 100 executes the double sided printing only for double sides of a single sheet S. In the double sides A mode, the controller 100 forms an image corresponding to the first page on a second surface of a certain sheet S after forming an image corresponding to the second page on a first surface of the certain sheet S. That is, the controller 100 executes the double sided printing in order of the second page and the first page in a case where the number of pages to be printed is two.

"Double sides B" illustrated in the column of the double sided mode in each of the first table and the second table is a mode in which the controller 100 executes the double sided printing for double sides of two sheets S. In the double sides B mode, the controller 100 prints an image corresponding to the fourth page on a first surface of a second sheet S secondly picked up from the sheet tray 31 after printing an image corresponding to the second page on a first surface of a first sheet S picked up from the sheet tray 31. And then, the controller 100 prints an image corresponding to the third page on a second surface of the second sheet S, which has been turned upside down, after printing an image corresponding to the first page on a second surface of the first sheet S which has been turned upside down. That is, the controller 100 executes the double sided printing in order of the second page, the fourth page, the first page and the third page in a case where the number of pages to be printed is four.

"Double sides C" illustrated in the column of the double sided mode in the first table is a mode in which the controller 100 executes the double sided printing for double sides of three or more sheets S. In this mode, the controller 100 executes the double sided printing in order of the second page, the fourth page, the sixth page, the first page, . . . , in a case where the number of pages to be printed is six or more. Specifically, the controller 100 executes the double sided printing in order of the second page, the fourth page, the sixth page, and the first page, and then the controller 100 executes the double sided printing in order of an even numbered page, an odd numbered page, and an even numbered page. The last printing in the double sided printing is printing for an odd numbered page. It is noted that there is a case in which a plurality of odd numbered pages are successively printed at an end of the double sided printing. This is because there is no need to enter a new sheet S between two sheets S on which images have been printed respectively.

"Double sides D" illustrated in the column of the double sided mode in the second table is a mode in which the controller 100 executes the double sided printing for double sides of three or more sheets S. In this mode, the controller 100 executes the double sided printing in a different order from the order of the double sides C in the first table. In this mode, the controller 100 executes the double sided printing in order of the second page, the fourth page, the first page, the sixth page, . . . , in a case where the number of pages to be printed is six or more. Specifically, the controller 100 executes the double sided printing in order of the second page, the fourth page, the first page, and the sixth page, and then the controller 100 executes the double sided printing in order of an odd numbered page, an even numbered page, and an add numbered page. The last printing in the double sided printing is printing for an odd numbered page. It is noted that, as similar to the double sides C mode, there is a case in which a plurality of odd numbered pages are successively printed at an end of the double sided printing.

There are two modes, a first curl-suppressing mode in which the controller 100 controls the second flapper FL2 to perform the single sided printing by using the two conveyance paths 91, 92 and a second curl-suppressing mode in which the controller 100 performs the single sided printing by using only the first conveyance path 91 without controlling the second flapper FL2, as the curl-suppressing process executable by the controller 100. As similar to the above described double sided printing, the two modes may be respectively, for example, set for models, may be selectable, for example, by a user.

The controller 100 determines an order of virtual pages based on a first curl-suppressing table illustrated in FIG. 7C in a case where the controller 100 executes the first curl-suppressing mode. The controller 100 determines an order of virtual pages based on a second curl-suppressing table illustrated in FIG. 7D in a case where the controller 100 executes the second curl-suppressing mode.

Here, the virtual pages are pages for provisionally determining an order of being conveyed to and contacting the photoconductor drum 61 for a first surface and a second surface of each of at least one sheet S in the single sided printing, and the virtual pages correspond to the pages in the double sided printing. Specifically, a virtual page "2N" is allocated to a first surface of the Nth sheet S, and a virtual page "2N−1" is allocated to a second surface of the Nth sheet S. For example, in a case where the number of printing is two, a first surface of the first sheet S corresponds to the second page of the virtual page, a second surface of the first sheet S corresponds to the first page of the virtual page, a first surface of the second sheet S corresponds to the fourth page of the virtual page, and a second surface of the second sheet S corresponds to the third page of the virtual page. The controller 100 determines the order of the virtual pages as similar to the determination of the order of pages in the double sided printing.

Specifically, in a single side A mode in which the controller 100 executes the curl-suppressing process for a single sheet S in the single sided printing, an order of the virtual pages is determined in order of the second page and the first page as in the case of the order of pages in the double side A mode. In a single side B mode in which the controller 100 executes the curl-suppressing process for two sheets S in the single sided printing, an order of the virtual pages is determined in order of the second page, the fourth page, the first page and the third page as in the case of the order of pages in the double side B mode. In a single side C mode in which the controller 100 executes the curl-suppressing process for three or more sheets S in the single sided printing, an order of the virtual pages is determined in order of the second page, the fourth page, the sixth page, the first page, . . . as in the case of the order of pages in the double side C mode. In a single side D mode in which the controller 100 executes the curl-suppressing process for three or more sheets S in the single sided printing, an order of the virtual pages is determined in order of the second page, the fourth page, the first page, the sixth page, . . . as in the case of the order of pages in the double side D mode.

In a case where the controller 100 executes the curl-suppressing process, the controller 100 is configured to supply the sheet S in the sheet tray 31 to the image forming unit 4 when the virtual page is an even number. The controller 100 executes the non-actual-printing process when the virtual page is an even number, and the controller 100 executes the actual-printing process when the virtual page is an odd number. Accordingly, in a case where the controller 100 performs the single sided printing in the single side A mode, the controller 100 forms an image corresponding to the actual first page in the single sided printing on a second surface of the sheet S corresponding to the first page of the virtual page without forming an image on a first surface of the sheet S corresponding to the second page of the virtual page. That is, the controller 100 executes the single sided printing for a single page.

In a case where the controller 100 executes the curl-suppressing process in the single side B mode, the single side C mode, or the single side D mode, that is, in a case where the controller 100 executes the curl-suppressing process for a plurality of sheets S in the single sided printing, the controller 100 executes the non-actual-printing process for a first sheet S (the second page of the virtual page) as the first supplied sheet S from the sheet tray 31, and then the controller 100 successively executes the non-actual-printing process for a second sheet (the fourth page of the virtual page) as the second supplied sheet S supplied from the sheet tray 31 by the supplier 32 and supplied next to the first supplied sheet S. In the case where the controller 100 performs the single sided printing in the single side B mode, that is, the controller 100 executes the curl-suppressing process for two sheets S in the single sided printing, the controller 100 executes the actual-printing process for the first sheet S (the first page of the virtual page) and the second sheet S (the third page of the virtual page) in order of the first sheet S and the second sheet S after executing the non-actual-printing process for the second sheet (the fourth page of the virtual page).

In a case where the controller 100 executes the curl-suppressing process for three or more sheets S in the single sided printing, specifically, in a case where the controller 100 executes the single sided printing in the single side D mode, the controller 100 executes the actual-printing process for the first sheet S (the first page of the virtual page) after executing the non-actual-printing process for the second sheet S (the fourth page of the virtual page), and then the controller 100 executes the non-actual-printing process for a third sheet S (the sixth page of the virtual page) as the supplied from the sheet tray 31 by the supplier 21 and supplied next to the second supplied sheet S after executing the actual-printing process for the first sheet S.

In the case where the controller 100 executes the curl-suppressing process for three or more sheets S in the single sided printing, specifically, in a case where the controller 100 executes the single sided printing in the single side C mode, the controller 100 executes the non-actual-printing process for the second sheet S (the fourth page of the virtual page), and then the controller 100 successively executes the non-actual-printing process for the third sheet (the sixth page of the virtual page) supplied next to the second supplied sheet S by the supplier 32. Moreover, in a case where the controller 100 executes the single sided printing for four or more sheets S in the single side C mode, the controller 100 executes the actual-printing process for the first sheet S (the first page of the virtual page) after executing the non-actual-printing process for the third sheet S (the six page of the virtual page), and then the controller 100 executes the non-actual-printing process for a fourth sheet S (the eighth page of the virtual page) supplied next to the third sheet S by the supplier 32 after executing the actual-printing process for the first sheet S.

The controller 100 can execute the curl-suppressing process when information input by a user indicating a kind of sheet S represents information indicating a predetermined kind of sheet. In the present embodiment, the information indicating the kind of sheet S is input by operating an operation panel and operation buttons provided on an outer surface of the body housing 2 by the user. Specifically, the user inputs the information indicating the kind of sheet, or the like by operating the operation panel and the operation buttons when printing data stored in a USB memory in a state in which the USB memory storing the data is connected to the body housing 2.

Moreover, in the present embodiment, the controller 100 has a function of notifying information to the user through the operation panel for allowing the user to select whether the controller 100 executes the curl-suppressing process or not in a case where the information indicating the kind of sheet S represents the predetermined kind of sheet. The controller 100 executes the curl-suppressing process based on the selection of executing the curl-suppressing process.

Moreover, the controller 100 has a function of reducing the nip pressure such that the nip pressure at which the controller 100 executes the non-actual-printing process is less than the nip pressure at which the controller 100 executes the actual-printing process. Specifically, for example, in a case where the controller 100 executes the non-actual-printing process in a state in which the nip state is a state other than the low nip state, the controller 100 controls the nip-pressure changing mechanism 300 such that the nip state becomes the low nip state. In a case where the controller 100 executes the actual-printing process, the controller 100 controls the nip-pressure changing mechanism 300 such that the nip state becomes the middle nip state or the strong nip state.

Figure 8:
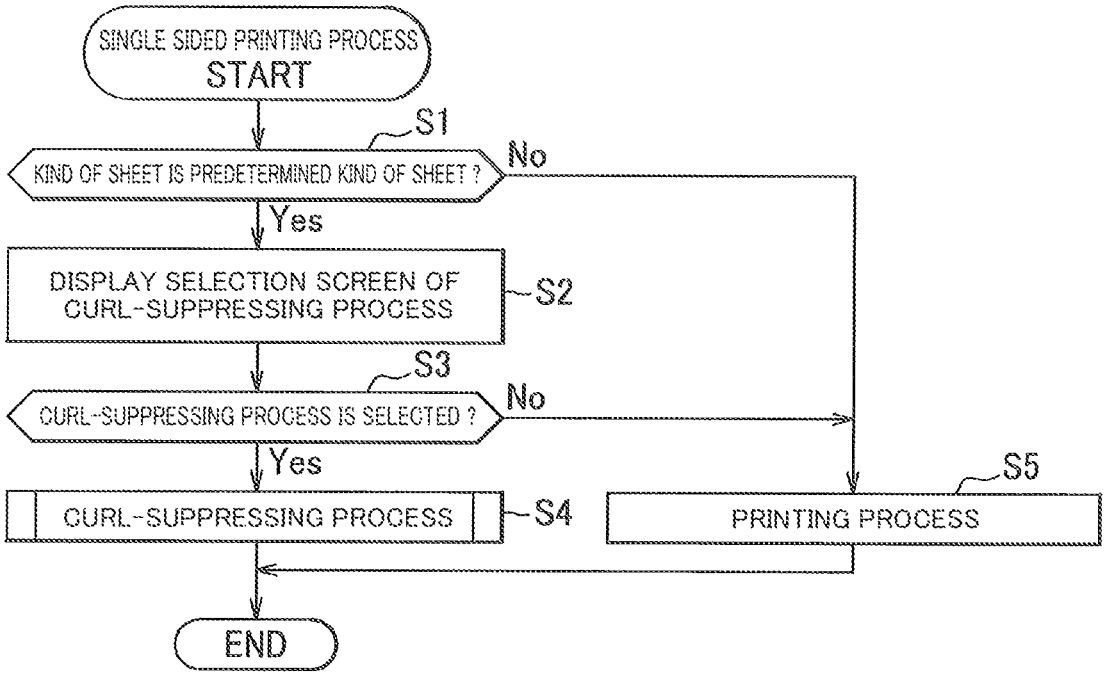
FIG. 8 is a flowchart illustrating a single sided printing process.

There will be next described operations of the controller 100 in details. The controller 100 executes a single sided printing process illustrated in FIG. 8 when the controller 100 receives a print instruction of executing the single sided printing. The single sided printing is printing of printing an image only on a first surface of the sheet S, not on a second surface, which is opposite to the first surface, of the sheet S. For example, in a case where the controller 100 executes the single sided printing on a first sheet S and a second sheet S that is supplied next to the first sheet S from the sheet tray 31, the controller 100 prints an image on the first surface of the first sheet S, not on the second surface of the first sheet S, and prints an image on the first surface of the second sheet S, not on the second surface of the second sheet S. In the single sided printing process, the controller 100 first determines whether a kind of the sheet S is the predetermined kind of sheet (S1).

At step S1, it is determined that the kind of the sheet S is the predetermined kind of sheet (S1: YES), the controller 100 displays a selection screen for allowing the user to select whether the controller 100 executes the curl-suppressing process or not on the operation panel (S2). The selection screen is a screen on which a message indicating "execute the curl-suppressing process?" and "YES" and "NO" buttons for selecting execution of the curl-suppressing process are displayed, for example.

After step S2, the controller 100 determines whether the execution of the curl-suppressing process is selected or not (S3). At step S3, it is determined that the execution the curl-suppressing process is selected (S3: YES), the controller 100 ends this flowchart after executing the curl-suppressing process (S4). It is noted that the curl-suppressing process will be described below.

It is negatively determined at step S1 or step S3 (S1: NO or S3: NO), the controller 100 executes a normal printing process, that is, a printing process in which the controller 100 discharges the sheet S, as it is, to the discharge tray 21 without turning the sheet S upside down after forming an image on a first surface of the sheet S. That is, when continuously performing the single-sided printing for a first sheet and a second sheet in this order, the controller 100 forms an image on the first surface of the first sheet and discharges the first sheet to the discharge tray 21 without turning the first sheet upside down, and then the controller 100 forms an image on the first surface of the second sheet and discharges the second sheet to the discharge tray 21 without turning the second sheet upside down.

Figure 9:
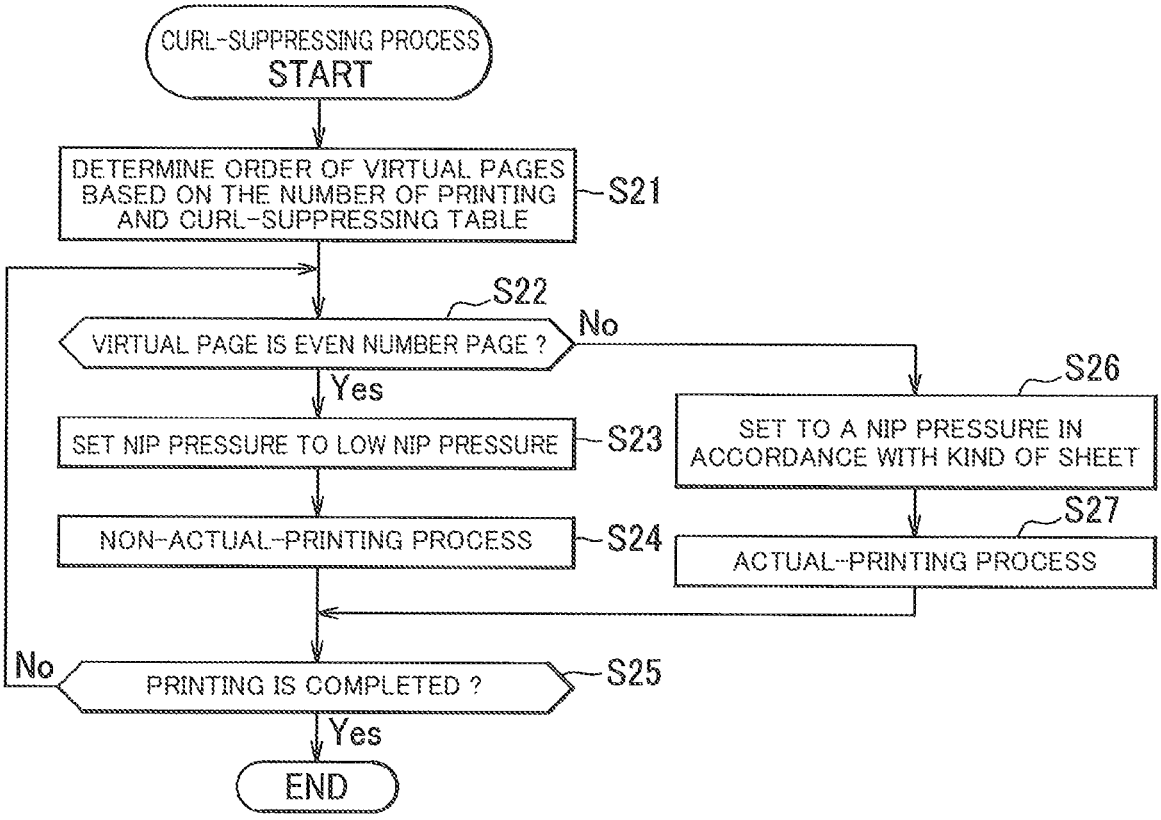
FIG. 9 is a flowchart illustrating a curl-suppressing process.

As illustrated in FIG. 9, in the curl-suppressing process, the controller 100 first determines the order of the virtual pages based on the number of printing and the curl-suppressing table (S21). After step S21, the controller 100 determines whether the number of the present virtual page is an even number (S22).

At step S22, it is determined that the number of the virtual page is an even number (S22: YES), the controller 100 sets the nip pressure to the low nip pressure (S23), and the controller 100 controls the nip-pressure changing mechanism 300 properly. After step S23, the controller 100 executes the non-actual-printing process (S24).

After step S24, the controller 100 determines whether printing is completed or not (S25). At step S25, when the controller 100 positively determines (S25: YES), the controller 100 ends the flowchart, and when the controller 100 negatively determines (S25: NO), the flow returns to step S22, and the controller 100 determines whether the number of the next virtual page is an even number at step S22.

At step S22, when it is determined that the number of the virtual page is not an even number (S22: NO), the controller 100 sets the nip pressure to a nip pressure corresponding to the kind of the sheet S (S26), and controls the nip-pressure changing mechanism 300 properly. After step S26, the controller 100 executes the actual-printing process (S27), and the flow goes to step S25.

There will be next described an example of operations of the controller 100 in details. In a case where the controller 100 prints the data stored in the USB memory connected to the body housing 2 in the single sided printing, the user selects the single sided printing as the printing mode by operating the operation panel, and when the button is pushed in a state in which the kind of the sheet S is selected to the predetermined kind of sheet, a print instruction including the data and information selected by the user is output to the controller 100. When the controller 100 receives the print instruction, the controller 100 executes the single sided printing process illustrated in FIG. 8.

In the single sided printing process, the controller 100 positively determines (S1: YES) in a case where the kind of sheet S is the predetermined kind of sheet. And then, the controller 100 displays the selection screen for allowing the user to select whether the curl-suppressing process is executed or not (S2).

When it is determined that the user selects non-execution of the curl-suppressing process in the selection screen (S3: NO), the controller 100 executes the normal printing process. According to this, since the sheet S is not re-conveyed to the image forming unit 4, it is possible to execute a high speed printing in preference to suppressing the curl of the sheet S.

when the user selects the execution of the curl-suppressing process in the selection screen (S3: YES), the controller 100 executes the curl-suppressing process (S4). In the curl-suppressing process illustrated in FIG. 9, the controller 100 determines the order of the virtual pages based on the number of printing and the curl-suppressing table (S21).

Specifically, for example, in a case where the first curl-suppressing table illustrated in FIG. 7C is set to as the curl-suppressing table, the controller 100 determines the order of the virtual pages in order of the second page, the fourth page, the sixth page, the first page, the eighth page, the third page, the fifth page and the seventh page when the number of printing is four. And then, in a case where the sheet S corresponding to an even page of the virtual page is conveyed to the image forming unit 4, the controller 100 executes the non-actual-printing process by changing the nip pressure to the low nip pressure. In a case where the sheet S corresponding to an odd page of the virtual page is conveyed to the image forming unit 4, the controller 100 executes the actual-printing process by changing the nip pressure to a nip pressure corresponding to the kind of the sheet S (S23-S27). As a result of this, in a case where the controller 100 executes the curl-suppressing process for four sheets S in the single sided printing, the controller 100 executes the actual-printing process for the second surface of the first sheet S after executing the non-actual-printing process for the first surface of each of the first sheet S, the second sheet S and the third sheet successively. And then, the controller 100 executes the actual-printing process for the second surface of each of the second sheet, the third sheet and the fourth sheet after executing the non-actual-printing process for the first surface of the fourth sheet S.

Moreover, for example, in a case where the kind of sheet is a kind of a sheet to be printed in the strong nip pressure or the middle nip pressure, the controller 100 sets the nip pressure to the low nip pressure when the controller 100 executes the non-actual-printing process, and the controller 100 sets the nip pressure to the strong nip pressure or the middle nip pressure when the controller 100 executes the actual-printing process. It is noted that, in a case where the kind of the sheet is a kind of a sheet to be printed in the low nip pressure, the controller 100 executes each of the non-actual-printing process and the actual-printing process in the low nip pressure without changing the nip pressure As described above, it is possible to achieve the following effects in the present embodiment. In a case where the controller 100 executes the curl-suppressing process for a plurality of sheets S in the single sided printing, the controller 100 executes the non-actual-printing process for the second sheet S that is the second supplied sheet S from a timing when the controller 100 executes the non-actual-printing process for the first sheet S that is the first supplied sheet S to a timing when the controller 100 executes the actual-printing process for the first sheet S, accordingly, it is possible to suppress the curl of the sheet S without reducing the speed of printing.

In a case where the controller 100 executes the curl-suppressing process for two sheets S in the single sided printing, the controller 100 successively executes the actual-printing process for the first sheet S and the second sheet S by the single sided mode, accordingly, it is possible to suppress reduction of the speed of printing.

In a case where the controller 100 executes the curl-suppressing process for three sheets S in the single sided printing by the single side D mode, the controller 100 executes the actual-printing process for the first sheet S (the first page of the virtual page) and the non-actual-printing process for the third sheet S that is the third supplied sheet (the six page of the virtual page) from a timing when the controller 100 executes the non-actual-printing process for the second sheet S (the fourth page of the virtual page) to a timing when the controller 100 executes the actual-printing process for the second sheet S (the third page of the virtual page), accordingly, it is possible to suppress reduction of the speed of printing.

In a case where the controller 100 executes the curl-suppressing process for three or more of sheets S in the single sided printing by the single side C mode, the controller 100 executes the non-actual-printing process for the second sheet S and the third sheet S (the fourth page and the sixth page of the virtual page) from a timing when the controller 100 executes the non-actual-printing process for the first sheet S (the second page of the virtual page) to a timing when the controller 100 executes the actual-printing process for the first sheet (the first page of the virtual page), accordingly, it is possible to suppress reduction of the speed of printing.

In a case where the controller 100 executes the curl-suppressing process for four or more of sheets S in the single sided printing by the single side C mode, the controller 100 executes the actual-printing process for the first sheet S (the first page of the virtual page) and the non-actual-printing process for the fourth sheet S (the eighth sheet 8 of the virtual page) from a timing when the controller 100 executes the non-actual-printing process for the third sheet S (the sixth page of the virtual page) to a timing when the controller 100 executes the actual-printing process for the second sheet (the third page of the virtual page), accordingly, it is possible to suppress reduction of the speed of printing.

Since the user can select either execution of the curl-suppressing process or non-execution of the curl-suppressing process, it is possible to suppress the curl of the sheet S by executing the curl-suppressing process when the user considers suppression of the curl of the sheet S is important, and it is possible to execute the normal printing when the user considers the high speed printing is important.

Since the controller 100 executes the curl-suppressing process based on the information indicating the kind of the sheet S input by the user, it is possible to suppress the curl of the sheet S based on the kind of sheet S input by the user.

In a case where the controller 100 executed the non-actual-printing process, the controller 100 sets the nip pressure to the low nip pressure, accordingly, it is possible to reduce the load to the fixing unit 80 in the non-actual-printing process, and suppress degradation of the fixing unit 80 caused by the large number of execution of the non-actual-printing process.

Especially, in the present embodiment, when the controller 100 sets the nip pressure to the low nip pressure, the belt 130 is nipped between only the first pad P1 and the roller 120, accordingly, it is possible to reduce the nip width and the nip pressure, and suppress degradation of the fixing unit 80 caused by the large number of execution of the non-actual-printing process.

While the embodiments have been described above, it is to be understood that the disclosure is not limited to the details of the illustrated embodiments, but may be embodied, as described below, with various changes and modifications which may occur to those skilled in the art, without departing from the spirit and scope of the disclosure.

In the present embodiment, the user inputs the information indicating the kind of the sheet by operating the operation panel, and the like, however, the present disclosure is not limited this configuration. For example, the user may input the information indicating the kind of sheet by operating a terminal such as a personal computer. That is, the present disclosure is not limited to a configuration in which the controller 100 displays the selection screen of the curl-suppressing process which allows the user to select whether the curl-suppressing process is executed or not, and information indicating the kind of sheet may be input by operations of a terminal such as a personal computer by the user.

In the present embodiment, the controller 100 displays the selection screen of the curl-suppressing process and allows the user to select whether the controller 100 executes the curl-suppressing process or not, however, the present disclosure is not limited to this configuration. The selection screen may not be displayed. That is, when the information indicating the kind of the sheet input by the user is the predetermined kind of sheet, the controller may execute the curl-suppressing process without allowing the user to select execution of the curl-suppressing process.

In the present embodiment, the controller 100 switches the nip state among the strong nip state, the middle nip state and the low nip state, however, the present disclosure is not limited this configuration. The controller 100 may switch the nip state between the strong nip state and the low nip state, and may switch among four or more states including the strong nip state and the low nip state. In the present embodiment, when executing the non-actual-printing process, the controller 100 reduces the nip pressure smaller than in the case where the controller 100 executes the actual-printing process, however, the present disclosure is not limited to this configuration. The nip pressure in the non-actual-printing process may be set to the same value as the nip pressure in the actual-printing process.

The present disclosure is applied to the color printer 1 in the above embodiment; however, the present disclosure is not limited to this configuration. The present disclosure may be applied to other image forming apparatuses, for example, a monochrome printer, a copy machine, a multifunction peripheral, and the like.

The configuration in which the second fixing member 82 is moved with respect to the first fixing member 81 is adopted in the above embodiment; however, the present disclosure is not limited to this configuration. It is also preferable to move the first fixing member with respect to the second fixing member.

Any type of heater, which is, for example, a carbon heater can be adopted. A plurality of heaters may be used.

The nip forming member is formed by the pad and the fixing plate in the above embodiment; however, the present disclosure is not limited to this configuration. The nip forming member may be formed, for example, only by the pad.

The second spring 330 and the cam follower 350 are provided in the above embodiment; however, the present disclosure is not limited to this configuration. It is not always necessary to provide the second spring and the cam follower. That is, a configuration in which the arm body can be directly pressed by the cam may be adopted.

The first pad P1 and the second pad P2 are made of rubber in the above embodiment; however, the present disclosure is not limited to this configuration. The pads may be made of, for example, rigid materials such as resin or metal which are not elastically deformed at the time of being pressurized.

Respective components explained in the above embodiment and modification examples may be arbitrarily combined to be achieved.

What is claimed is:

1. An image forming apparatus, comprising:

a sheet tray accommodating a sheet;

a feed roller configured to feed the sheet from the sheet tray;

a transfer roller configured to transfer a developer image onto the sheet fed by the feed roller;

a fuser configured to fix the developer image on the sheet by heating and pressing;

a conveying unit configured to convey the sheet which has passed the fuser in a state in which the sheet is turned upside down, the conveying unit being configured to re-convey the sheet to the transfer roller; and a controller configured to execute a normal process, when performing a single sided printing, the normal process being a process in which the controller is configured to form an image on a first surface of a first sheet without turning the first sheet upside down, and then configured to form an image on a first surface of a second sheet without turning the second sheet upside down, the second sheet being a sheet supplied next to the first sheet from the sheet tray, wherein the controller is configured to execute a particular process, when performing the single sided printing, the particular process being a process in which the controller is configured execute a non-actual-printing process on the first surface of the first sheet, and then configured to execute the non-actual-printing on the first surface of the second sheet before executing an actual-printing process on a second surface of the first sheet, which is opposite to the first surface, the non-actual-printing process being a process of conveying the sheet to the fuser without transferring the developer image onto the first surface of the sheet in the transfer roller, the actual-printing process being a process of transferring the developer image onto the second surface of the sheet and fixing the developer image on the second surface by the fuser, the actual-printing process being executed after the controller re-conveys the sheet that has been processed by the non-actual-printing process to the transfer roller by the conveying unit.

2. The image forming apparatus according to claim 1, wherein the particular process is a curl-suppressing process of suppressing curl of the sheet, and wherein, when performing the single sided printing for a plurality of sheets including the first sheet and the second sheet, the controller is configured to execute the curl-suppressing process.

3. The image forming apparatus according to claim 1, wherein, when performing the single sided printing for a plurality of sheet including the first sheet and the second sheet, the controller is configured to execute the non-actual-printing process for the first sheet in which the developer image is not transferred onto the first surface of the first sheet, and then configured to execute the non-actual-printing process for the second sheet before executing the actual-printing process for the first sheet in which the developer image is transferred onto the second surface of the first sheet.

4. The image forming apparatus according to claim 1, wherein, when performing the single sided printing for two sheets, the controller is configured to execute the actual-printing process for the first sheet and the second sheet in order of the first sheet and the second sheet after executing the non-actual-printing for the first sheet and the second sheet in order of the first sheet and the second sheet.

5. The image forming apparatus according to claim 1 wherein, when performing the single sided printing for three or more sheets, the controller is configured to:

execute the actual-printing process for the first sheet after executing the non-actual-printing process for the first sheet and the second sheet in order of the first sheet and the second sheet, and execute the non-actual-printing process for a third sheet that is supplied next to the second sheet after executing the actual-printing process for the first sheet.

6. The image forming apparatus according to claim 1, wherein, when performing the single sided printing for three or more sheets, the controller is configured to:

execute the actual-printing process for the first sheet after executing the non-actual-printing process for the first sheet and the second sheet in order of the first sheet and the second sheet, and execute the non-actual-printing process for a third sheet that is supplied next to the second sheet before executing the actual-printing process for the first sheet.

7. The image forming apparatus according to claim 6, wherein, when performing the singe sided printing for four or more of sheets, the controller is configured to:

execute the actual-printing process for the first sheet after executing the non-actual-printing process for the third sheet, and execute the non-actual-printing process for a fourth sheet that is supplied next to the third sheet after executing the actual-printing process for the first sheet.

8. The image forming apparatus according to claim 2, wherein the controller is configured to execute the curl-suppressing process when execution of the curl-suppressing process is selected by a user.

9. The image forming apparatus according to claim 8, wherein the controller is configured to form an image on the first surface of the sheet without turning the sheet upside down when execution of the curl-suppressing process is not selected by the user.

10. The image forming apparatus according to claim 2, wherein the controller is configured to execute the curl-suppressing process when information indicating a kind of sheet input by a user is information indicating a predetermined kind of sheet.

11. The image forming apparatus according to claim 10, wherein the controller is configured to form an image on the first surface of the sheet without turning the sheet upside down when information indicating a kind of sheet input by the user is not information indicating a predetermined kind of sheet.

12. The image forming apparatus according to claim 1, wherein the fuser includes:

a heating unit heated by a heater;

a pressing unit forming a nip portion with the heating unit, a sheet being nipped between the heating unit and the pressing unit in the nip portion; and a nip-pressure changing mechanism configured to change a nip pressure in the nip portion between a first nip pressure and a second nip pressure that is less than the first nip pressure, wherein, when executing the non-actual-printing process, the controller is configured to control the nip-pressure changing mechanism to change the nip pressure to the second nip pressure.

13. The image forming apparatus according to claim 12, wherein the pressing unit includes:

an endless belt;

a first nip forming member and a second nip forming member, the belt being nipped between each of the first nip forming member and the second nip forming member, and the heating unit, wherein the controller is configured to:

control the nip-pressure changing mechanism to change the nip pressure to the first nip pressure such that the belt is nipped between each of the first nip forming member and the second nip forming member and the pressing unit; and control the nip-pressure changing mechanism to change the nip-pressure to the second nip-pressure such that the belt is nipped between the first nip forming member and the pressing unit, and the belt is not nipped between the second nip forming member and the pressing unit.

14. The image forming apparatus according to claim 1, wherein the conveying unit includes:

a switchback roller configured to rotate in both forward and reverse directions, the switchback roller being configured to convey the sheet toward an outside of a body housing of the image forming apparatus at rotations in the forward direction, and draw the sheet into the body housing at rotations in the reverse direction; and a re-conveying roller configured to convey the sheet toward the feed roller.

15. The image forming apparatus according to claim 1, wherein the controller is configured to:

determine an order of virtual pages based on the number of printing, the virtual pages being pages for provisionally determining an order of contacting a photoconductor drum for the first surface and the second surface of each of at least one sheet in the single sided printing, execute the non-actual-printing process when the virtual page is an even number, and execute the actual-printing process when the virtual page is an odd number.

16. The image forming apparatus according to claim 15, wherein the controller is configured to:

perform a double sided printing for a plurality of sheets, and determine the order of the virtual pages in the single sided printing by the same manner as determination of the order of pages in the double sided printing.

17. An image forming apparatus, comprising:

a sheet tray accommodating a sheet;

a transfer roller configured to transfer a developer image on a sheet;

a fuser configured to fix the developer image on the sheet by heating and pressing the sheet; and a controller configured to execute:

an actual-printing process comprising:

transferring developer image on the sheet by the transfer roller and heating and pressing the sheet by the fuser; and a non-actual-printing process comprising:

heating and pressing the sheet by the fuser without transferring developer image on the sheet by the transfer roller;

wherein, when performing a normal printing, the controller is configured to execute the actual-printing process for a first sheet, and then configured to execute the actual-printing process for a second sheet that is a sheet supplied from the sheet tray next to the first sheet; and wherein, when performing an anti-curl printing, the controller is configured to execute the non-actual-printing process for the first sheet, then configured to execute the non-actual-printing process for the second sheet and, after the completion of the non-actual-printing process for the second sheet, configured to execute the actual-printing process for the first sheet and the second sheet.

18. The image forming apparatus according to claim 17, further comprising:

a feed roller configured to feed the sheet from the sheet tray to the transfer roller; and a re-convey path through which the sheet which has passed the fuser is re-conveyed to the transfer roller via the feed roller, wherein the controller is configured to execute the non-actual-printing process for the second sheet in a state in which the first sheet is in the re-convey path.

* * * * *